US008622509B2

(12) United States Patent
Olson

(10) Patent No.: US 8,622,509 B2
(45) Date of Patent: Jan. 7, 2014

(54) TOUCH-FREE NOZZLE SEALANT REMOVAL

(75) Inventor: Stephen Todd Olson, Lexington, KY (US)

(73) Assignee: Funai Electric Co., Ltd., Osaka (JP)

( * ) Notice: Subject to any disclaimer, the term of this patent is extended or adjusted under 35 U.S.C. 154(b) by 0 days.

(21) Appl. No.: 13/474,108

(22) Filed: May 17, 2012

(65) Prior Publication Data

US 2012/0224004 A1 Sep. 6, 2012

Related U.S. Application Data

(63) Continuation of application No. 12/611,986, filed on Nov. 4, 2009, now Pat. No. 8,313,164.

(51) Int. Cl.
*B41J 2/165* (2006.01)

(52) U.S. Cl.
USPC ..... 347/29

(58) Field of Classification Search
None
See application file for complete search history.

(56) References Cited

U.S. PATENT DOCUMENTS

| | | | | |
|---|---|---|---|---|
| 6,764,170 | B2 * | 7/2004 | Ardito | 347/86 |
| 7,611,222 | B2 * | 11/2009 | Cray et al. | 347/29 |
| 2006/0221119 | A1 * | 10/2006 | Bertelsen et al. | 347/29 |

* cited by examiner

*Primary Examiner* — Matthew Luu
*Assistant Examiner* — Erica Lin
(74) *Attorney, Agent, or Firm* — Amster, Rothstein & Ebenstein LLP

(57) ABSTRACT

A method for automatic removal of a sealant member from a nozzle plate that includes applying a sealant member to a surface of the nozzle plate, attaching the sealant member with a pull tab, one end of the pull tab being attached to a maintenance sled of a maintenance mechanism at a first position, the maintenance sled moves from a first position to a second position thereby removing the sealant member at a 180 degree angle and with a speed of about 10 mm/sec.

13 Claims, 6 Drawing Sheets

TOUCH-FREE NOZZLE SEALANT REMOVAL

This application claims priority and benefit as a continuation of U.S. patent application Ser. No. 12/611,986, filed Nov. 4, 2009 now U.S. Pat. No. 8,313,164.

BACKGROUND

1. Field of the Invention

The present invention relates to a print head with a sealant member and, more particularly, to a method for removing the sealant member automatically by a maintenance sled of a maintenance mechanism of an image forming apparatus when the image forming apparatus is powered on.

2. Description of the Related Art

Thermal ink jet print heads that contain an ink supply from the factory utilize a low vacuum level to retain the various ink colors within their nozzles. Changes in atmospheric pressure, as well as shock and vibration, require that the nozzles be sealed against leakage during shipment. Prior to first use, the nozzle seals must be removed. Historically, manufacturers have relied upon their customers to remove the nozzle seals. Photo imageable nozzle plate (PINP) materials are more susceptible to mechanical damage during the removal of sealing means than their predecessors were. Mechanical stress applied during removal of sealing means can be minimized if the rate and angle of removal can be controlled. The nozzle seals can be made from pressure sensitive adhesive (PSA) materials as they maintain a level of tack sufficient to prevent ink leakage around each nozzle during storage and shipment to customers. The substrate upon which these acrylic adhesives are applied has been limited to polyimide, and specifically laser ablated Upilex. Within the printhead manufacturing facility, each head is inspected 24 hours after initial application of the PSA to ensure that no ink leakage has occurred. If ink leakage is detected, the PSA is removed from the nozzle plate, discarded, and a PSA tape is re-applied. The process of sealing and removal can be repeated up to three times before the entire print head is declared unsuitable for customer use. If the printhead passes the 24 hour leak inspection, another removal will be performed by the customer at the time of print head installation into a printer. New sealing materials and processes have been developed to comply with the aforementioned strength limitations and these materials include lower adhesion PSA as well as UV curable sealants. The new materials have addressed the problem of excessive stress during seal removal by lowering the adhesion, but have not addressed the inherent stress induced by the seal removal angle and speed.

Therefore, it would be desirable to provide a method to replace the variables associated with customer removal with automatic removal of a seal from the nozzle plate to ensure a specific removal angle and a specific removal speed when an image forming apparatus is powered on for the first time after the installation of an ink supply. Automated removal will allow for highly reliable removal of the seals thereby eliminating at least one source of error.

SUMMARY OF THE INVENTION

Disclosed herein is an image forming apparatus that includes an inkjet printhead including a nozzle plate, the nozzle plate having a plurality of nozzle holes formed therein, a sealant member arranged to cover the nozzle holes of the nozzle plate, a pull tab member attached to at least a portion the sealant member, a maintenance mechanism having a maintenance sled located below the print head, the pull tab being attached to the maintenance sled, the maintenance sled being positioned at a first position, wherein movement of the maintenance sled from the first position to a second position pulls the sealant member and the pull tab member from the nozzle plate.

In some embodiments, as the maintenance sled moves from the first position towards the second position, the sealant member is removed from the nozzle plate at a peel angle of about 180°.

In another embodiment, as the maintenance sled moves from the first position to the second position, the sealant member is removed from the nozzle plate at a speed of about 10 mm/sec.

In yet another aspect of the invention, disclosed is a method of providing a sealant member on a nozzle plate of a printhead that is automatically removed upon first use of the printhead, the method comprising applying a sealant member to a surface of the nozzle plate, attaching the sealant member to a pull tab, one end of the pull tab being attached to a maintenance sled of a maintenance mechanism at a first position, wherein the sealant member is removed by the maintenance sled as the maintenance sled moves from a first position to a second position upon first use of the printhead.

In some embodiments, the sealant member and the pull tab drops to a bottom of the maintenance sled and remains tethered to the maintenance sled when the sealant member is removed from the nozzle plate.

In yet another aspect of the invention, disclosed herein is an image forming apparatus comprising inkjet printhead including a nozzle plate, the nozzle plate having a plurality of nozzle holes formed therein and attached to a carrier of the inkjet printhead, the carrier of the inkjet printhead being positioned at a first position, a sealant member arranged to cover the nozzle holes of the nozzle plate, and a frame member having an attachment point located below the carrier of the inkjet printhead, the frame member including mechanical barbs to retain one end of the sealant member, wherein movement of the carrier of the inkjet printhead from the first position to a second position pulls the sealant member from the nozzle plate.

In yet another embodiment, the carrier of the inkjet printhead moves from the first position to the second position when the image forming apparatus is powered on for a first time.

BRIEF DESCRIPTION OF THE DRAWINGS

The above-mentioned and other features and advantages of the various embodiments of the invention, and the manner of attaining them, will become more apparent and will be better understood by reference to the accompanying drawings, wherein.

DETAILED DESCRIPTION

Figure 1:
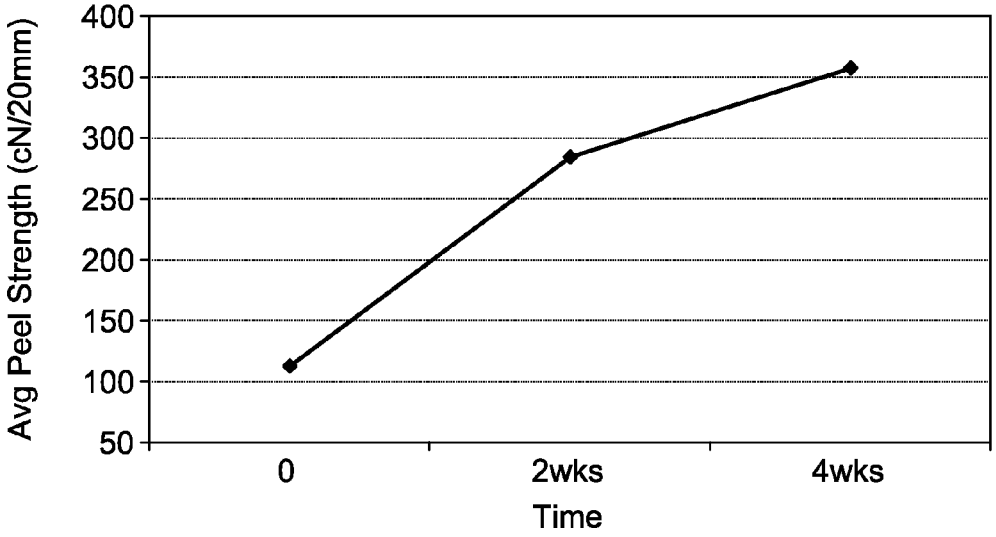
FIG. 1 shows a graph illustrating a relationship between peel strength of a PSA tape and a time period (aging time) at 60°C.

Reference will now be made in detail to the exemplary embodiment(s) of the invention as illustrated in the accompanying drawings. Whenever possible, the same reference numerals will be used throughout the drawings to refer to the same or like parts.

FIG. 1 illustrates a plot of peel strength of pressure sensitive adhesive (PSA) versus aging time at 60° C. on a nozzle plate substrate. The curve shows that there is an increase in peel strength over 4 weeks. A nozzle plate substrate has to be engineered to tolerate a minimum of one and, in one embodiment, up to four (PSA) removals. Secondly, the PSA removal by the customer is subject to significant variation as it is difficult to ensure a specific angle and/or speed of seal removal from the nozzle plate by the customer. Further, it is relevant from an engineering persepective to ensure a specific angle and/or speed of PSA removal from the nozzle plate substrate by the customer as the angle and speed impact the level of stress induced on the nozzle plate substrate material. For example, a peel angle of 180° minimizes the amount of stress placed on the nozzle plate, whereas a peel angle of 90° induces a maximum amount of stress placed on the nozzle plate. Similarly, a slow peel speed is better than a fast peel speed. To estimate the change in adhesion over time, samples are 'aged' at an elevated temperature, which simulates an extended period of time. As shown in FIG. 1, 60° Celsius for a duration of 4 weeks was used to simulate a year of shelf life at room temperature.

Figure 2:
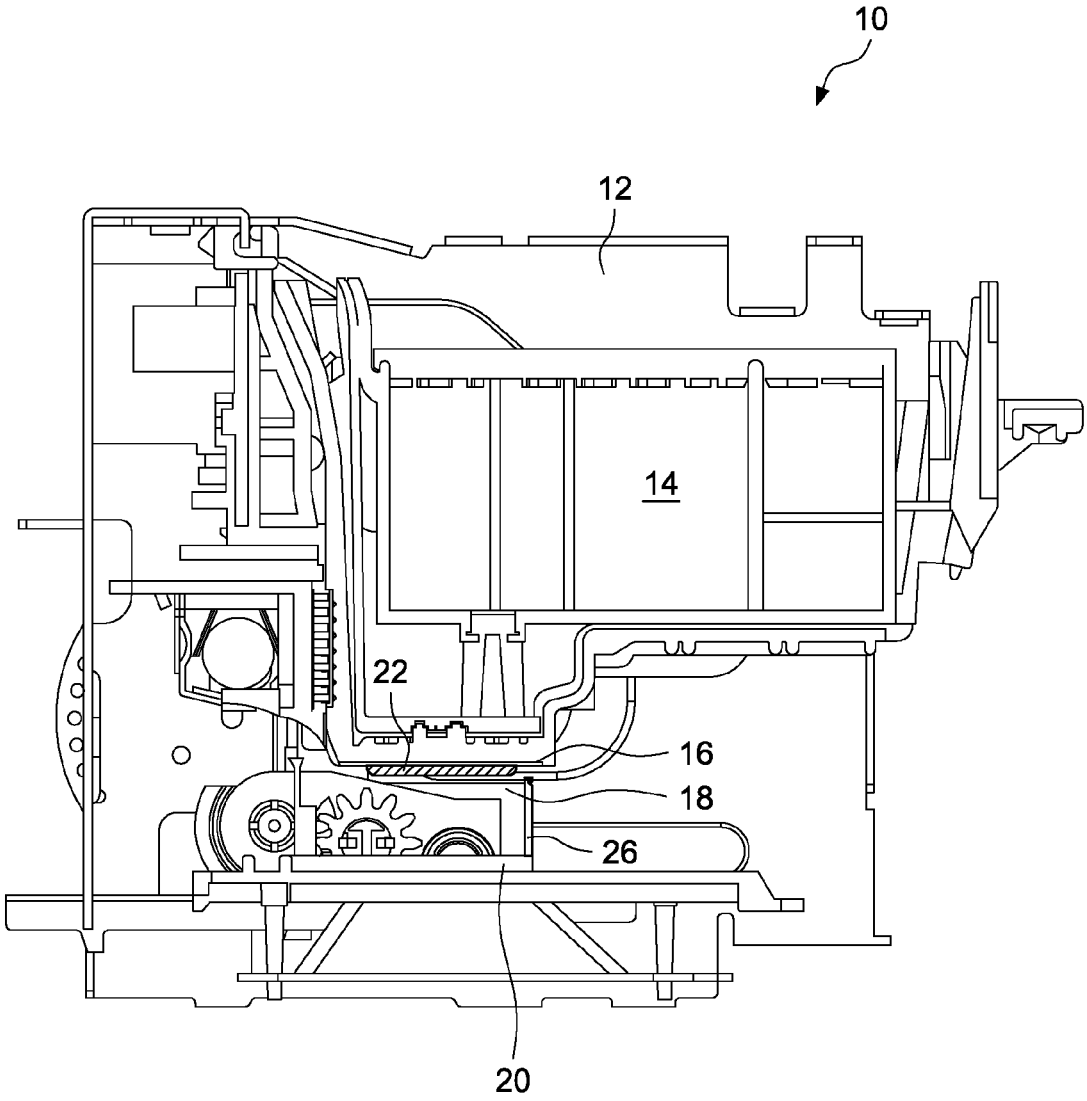
FIG. 2 is an elevational view of the side of one embodiment of an image forming apparatus with a printhead located over a maintenance sled and a sealant member attached to the nozzle plate of the printhead according to the present invention.

FIG. 2 is an elevational side view of part of an image forming apparatus 10 with a carrier assembly 12 and a print head 14, the print head 14 includes a nozzle plate 16 having plurality of nozzles holes (not shown) formed therein. The print head 14 is installed in the carrier assembly 12 that is located over a maintenance mechanism 18. The maintenance mechanism 18 includes a maintenance sled 20. A sealant member 22 is placed such that it covers the nozzle holes of the nozzle plate 16 and is removed when the image forming apparatus 10 is powered on for the first time.

Figure 3:
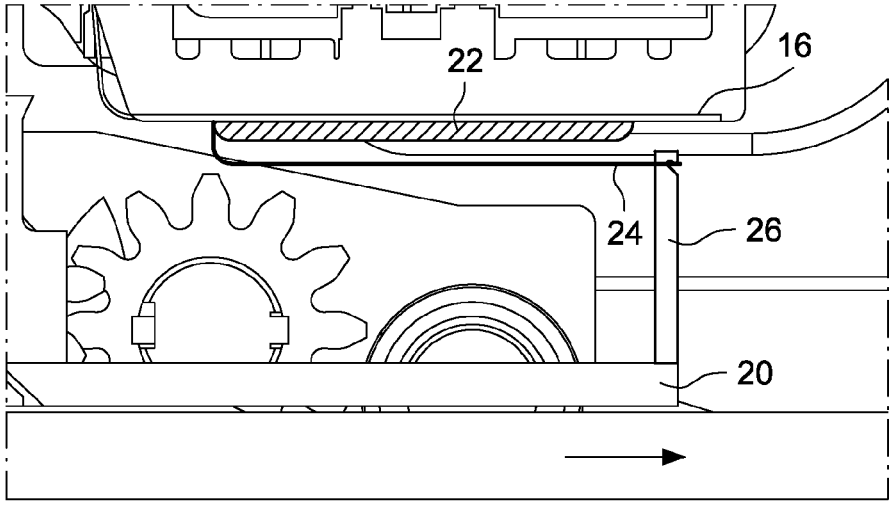
FIG. 3 is a partial side view of the sealant member attached to the nozzle plate of the printhead and the maintenance sled.

FIG. 3 illustrates a sealant member 22 in home position covering the nozzle holes of the nozzle plate 16 with the maintenance mechanism 18 in a home position. A pull tab 24 is attached to an attachment post 26 on the maintenance sled 20.

In some embodiments, the print head unit is permanently or semi-permanently integrated with the image forming apparatus 10 and the pull tab 24 may be secured to the attachment post 26 at the manufacturer site. In such case, the pull tab 24 is removed the first time the image forming apparatus is turned on. But in alternative embodiments, a disposable print head might be associated with an ink supply cartridge and the connection between the pull tab 24 and the attachment post 26 may need to occur at or near the time an ink supply is installed in the image forming device. In the embodiment illustrated in FIGS. 2-5, a pull tab 24 is shown physically connected to the sealant member 22 by a looped portion that wraps around a corresponding grooved portion of the attachment post 26. One option for making the connection between the pull tab 24 and the maintenance mechanism 18 is to have an operator manually attach the pull tab 24 to the attachment post 26 as part of an ink supply installation process. Using the embodiment in FIGS. 2-5 as an illustrative example, the installation process could require that an operator manually connect the pull tab 24 to the maintenance sled 18.

But complicating the installation process can be problematic, so another possible option is to design a pull tab 24 such that when a supply item is installed, a looped portion of a pull tab is disposed within the image forming device such that the maintenance mechanism 18 automatically grabs the pull tab 24 as it passes by the sealant member, and removes the sealant member the first time the ink supply unit is powered on after the ink supply installation occurs. One of ordinary skill in the art will readily recognize that there are multiple designs of the sealant member and/or pull tab that would allow a maintenance mechanism to connect to and remove the sealant member as the maintenance mechanism moves across the sealant member.

When the maintenance sled 20 moves from left to right, as indicated by the arrow, the pull tab 24 also moves along with the maintenance sled 20 and given the height of the attachment post 26 being so close to the sealant member 22, the sealant member 22 is removed at an angle of about 180°. While the sealant member 22 and pull tab 24 are described as two pieces, they may be one integral piece and still fall within the scope of the present invention.

Figure 4:
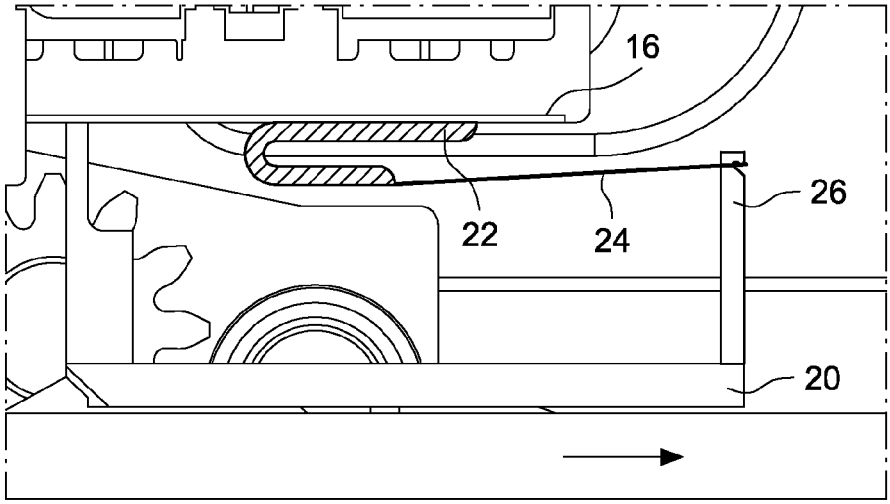
FIG. 4 is a partial side view showing the sealant member during removal as the maintenance sled transitions from a first position to a second position.

FIG. 4 illustrates the sealant member 22 partially removed from the nozzle holes and the 180 degree removal angle. The sealant member 22 is removed from its fixed position on the nozzle plate 16 (FIG. 3) by the maintenance sled 20 of the maintenance mechanism 18 when the image forming apparatus 10 is powered up for the first time. At power-up, the maintenance sled 20 moves from left, i.e., home position (FIG. 3), to the right in the direction of the arrow to remove sealant member 22. Due to the direction of travel of the maintenance sled 20 and the maintenance mechanism 18 and the attachment point of the pull tab 24 to the attachment post 26, a peel angle of about 180° is assured in removing the sealant member 22 from the nozzle plate 16. The angle of removal may also be changed by changing the relative positions of the nozzle plate 16 and the attachment post 26. Also, the speed of travel of the maintenance sled 20 and hence the removal speed of the maintenance mechanism 18, is controlled to a maximum of 10 mm/sec to ensure a low stress sealing means removal. Similarly, the nozzle plate 16 may also move relative to the attachment post 26 in order to remove the sealant member 22.

Figure 5:
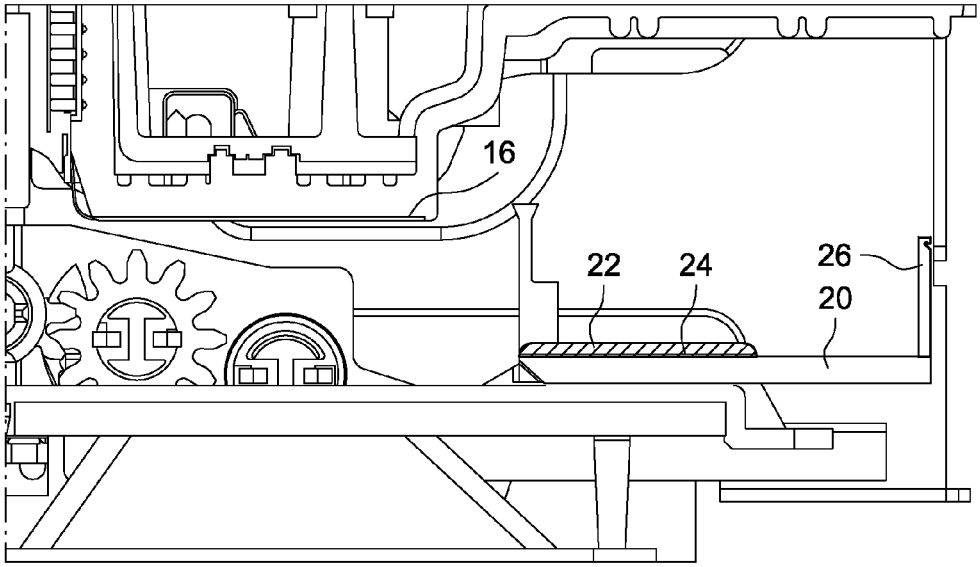
FIG. 5 is a partial side view of the sealant member after it is pulled from the nozzle plate and drops to the bottom of the maintenance sled.

FIG. 5 shows the sealant member 22 after it is pulled free of the nozzle plate 16 and the sealant member 22 drops to the bottom of the maintenance sled 20. The sealant member 22 falls over attachment post 26 of the maintenance sled 20 with the sealant member 22 landing nearby. The maintenance sled 20 of the maintenance mechanism 18, the carrier assembly 12 and the print head 14 then returns to the home position once the sealant member 22 falls over attachment post 26 to initiate priming of the print head 14.

Figure 6:
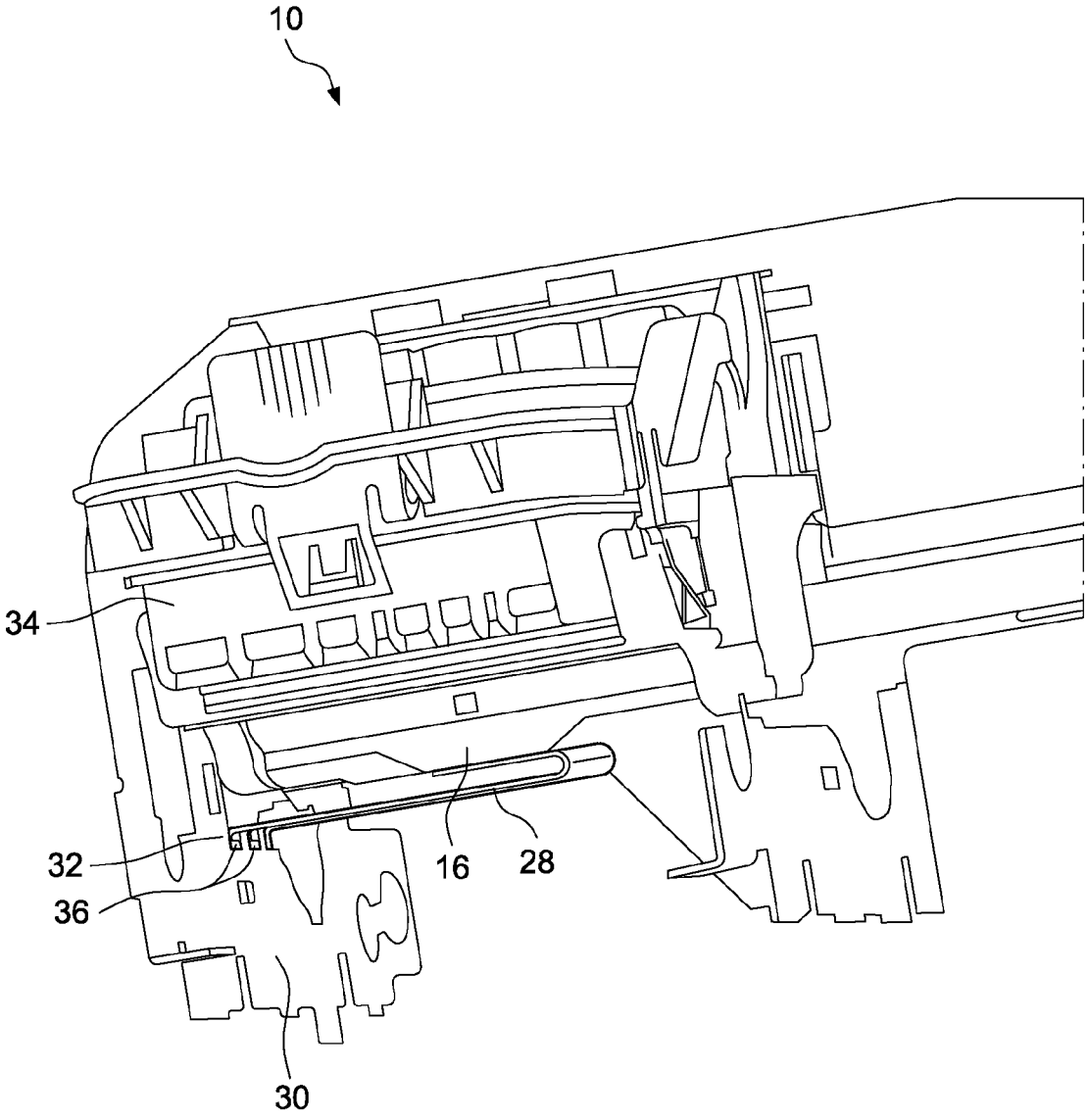
FIG. 6 is a perspective view of another embodiment where the sealing means is a Pressure Sensitive Adhesive (PSA) tape that is secured to an attachment point on a frame member of the image forming apparatus after a printhead carrier is installed according to one embodiment of present invention.

FIG. 6 shows another embodiment of a sealant member 28 which is a pressure sensitive adhesive (PSA) tape attached to the nozzle plate 16 that is attached to the print head carrier 34 according to the present invention. The PSA tape 28 is attached to the nozzle plate 16 in an initial position. One end of the PSA tape 28 is secured to an attachment point 32 on a frame member 30 of the image forming apparatus 10 after a printhead carrier 34 is installed. The frame member 30 preferably includes mechanical barbs 36 that assist in retaining one end of the PSA tape 28 as the PSA tape 28 is a low tack PSA tape. In this regard, PSA tape 28 can be utilized without relying solely on adhesion to the frame member 30 to retain the PSA tape 28 depending on the adhesion to the frame member 30. The printhead carrier 34 of the image forming apparatus removes the PSA tape 28 when the printhead carrier 34 moves from its original position (FIG. 6) to a second position (FIG. 7) when the image forming apparatus 10 is powered on for a first time.

Figure 7:
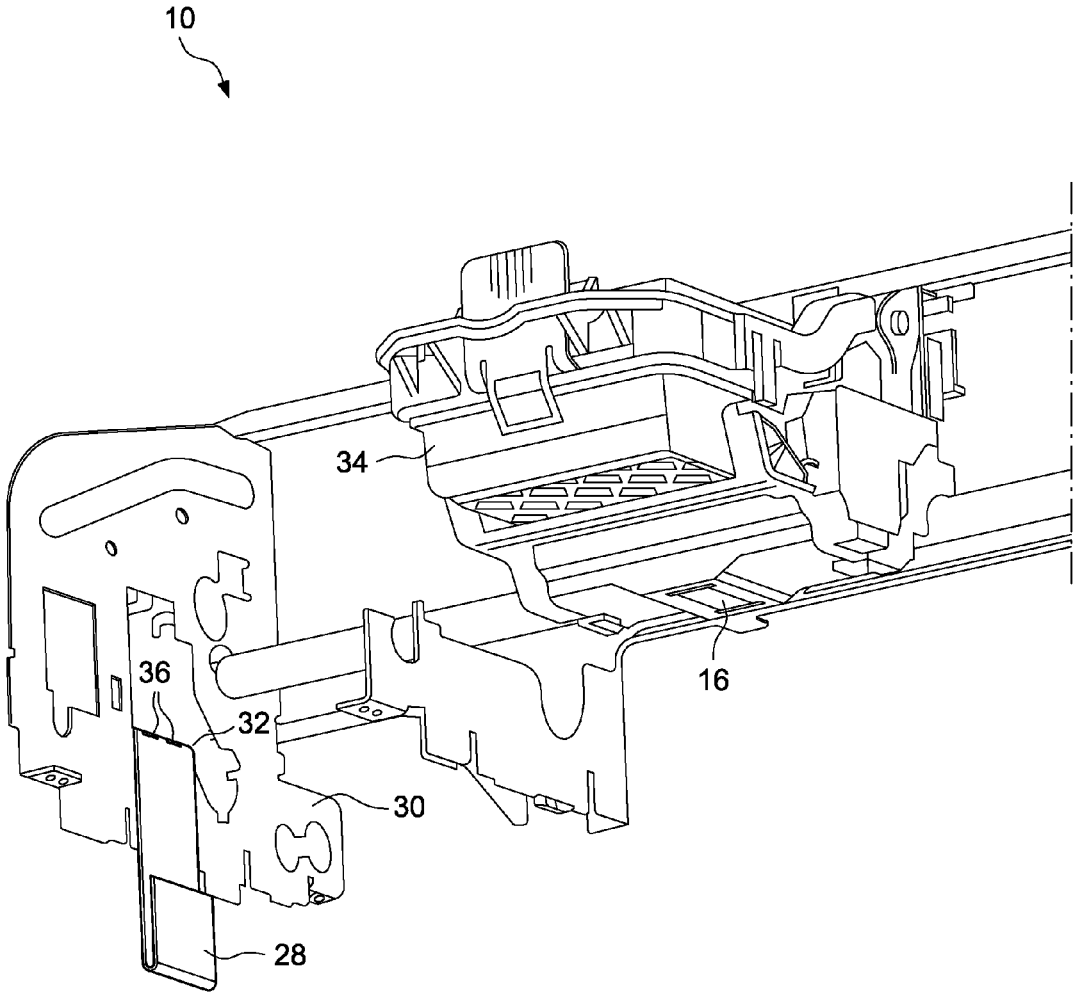
FIG. 7 illustrates an elevational view of the PSA tape of FIG. 6 being removed from the nozzle plate when the maintenance sled moves from first position to a second position.

The direction of travel of the printhead carrier 34 and the motion of the printhead carrier 34 are aligned in such a manner that when the printhead carrier 34 moves from the first position to the second position, the PSA tape 28 is removed by the print head carrier motion relative to the frame member 30 to ensure a peel angle of about 180°. Further, the speed of the printhead carrier 34, when moving from the first direction to the second direction, is controlled to a maximum of 10 mm/sec relative to the frame member 30 to ensure a low stress sealing member removal. Once the PSA tape 28 is pulled free of the nozzle plate 16 due to the relative motion of the printhead 14, the PSA tape 28 drops to the bottom of the image forming apparatus 10, where it remains tethered to the attachment point 32 as shown in FIG. 7.

By automatically removing the sealant member 22 as described above, there is a reduced risk of nozzle plate damage with the use of PSA tapes or UV curable sealants. The rate and angle of removal can also be optimized so the sealants are removed either parallel to vias (north-south) or orthogonal to the vias (east-west), depending on the configuration of the image forming apparatus. In both cases, the rate and angle can be controlled by design.

It will be apparent to those skilled in the art that various modifications and variations can be made to the present invention without departing from the spirit and scope of the invention. Thus it is intended that the present invention cover the modifications and variations of this invention provided they come within the scope of the appended claims and their equivalents.

What is claimed is:

1. A method of providing a sealant member on a nozzle plate of a printhead that is automatically removed upon first use of the printhead, the method comprising:

applying a sealant member to a surface of the nozzle plate; and attaching the sealant member to a maintenance sled of a maintenance mechanism at a first position, wherein as the maintenance sled moves from a first position to a second position upon first use of the printhead, the sealant member is removed from the nozzle plate with a peel angle of about 180° , and wherein the sealant members drops to a bottom of the maintenance sled and remains tethered to the maintenance sled after removal from the nozzle plate.

2. The method of claim 1, further including applying the sealant member as a UV curable sealant.

3. The method of claim 1, wherein as the maintenance sled moves from the first position towards the second position, further including removing the sealant member from the nozzle plate with a speed of about 10 mm/sec.

4. A method of providing a sealant member on a nozzle plate of a printhead that is automatically removed upon first use of the printhead, comprising:

applying a sealant member to a surface of the nozzle plate;

fixedly attaching an end of the sealant member to a maintenance sled of a maintenance mechanism at a first position;

moving the maintenance sled from the first position to a second position so that as the maintenance sled moves from the first position toward the second position, the sealant member is removed from the nozzle plate by the maintenance sled.

5. The method of claim 4, further including applying the sealant member as a UV curable sealant.

6. The method of claim 4, wherein as the maintenance sled moves from the first position towards the second position, further including removing the sealant member from the nozzle plate with a speed of about 10 mm/sec.

7. The method of claim 4, wherein the sealant member drops to a bottom of the maintenance sled and remains tethered to the maintenance sled after removal from the nozzle plate.

8. The method of claim 4, wherein the sealant member is removed from the nozzle plate with a peel angle of about 180°.

9. A method of providing a sealant member on a nozzle plate of a printhead that is automatically removed upon first use of the printhead, the method comprising:

applying a sealant member to a surface of the nozzle plate; and attaching the sealant member to a maintenance sled of a maintenance mechanism at a first position, wherein as the maintenance sled moves from a first position to a second position upon first use of the printhead, the sealant member is removed from the nozzle plate by the maintenance sled.

10. The method of claim 9, further including applying the sealant member as a UV curable sealant.

11. The method of claim 9, wherein as the maintenance sled moves from the first position towards the second position, further including removing the sealant member from the nozzle plate with a speed of about 10 mm/sec.

12. The method of claim 9, wherein the sealant member drops to a bottom of the maintenance sled and remains tethered to the maintenance sled after removal from the nozzle plate.

13. The method of claim 9, wherein the sealant member is removed from the nozzle plate with a peel angle of about 180°.

* * * * *